United States Patent [19]

Chandley

[11] Patent Number: 4,862,946

[45] Date of Patent: Sep. 5, 1989

[54] VACUUM COUNTERGRAVITY CASTING APPARATUS AND METHOD

[75] Inventor: George D. Chandley, Amherst, N.H.

[73] Assignee: General Motors Corporation, Detroit, Mich.

[21] Appl. No.: 275,408

[22] Filed: Nov. 23, 1988

[51] Int. Cl.[4] ..... B22D 18/06

[52] U.S. Cl. ..... 164/63; 164/255; 164/256

[58] Field of Search ..... 164/63, 255, 256, 137, 164/339, 341

[56] References Cited

U.S. PATENT DOCUMENTS

| | | | |
|---|---|---|---|
| 4,340,108 | 7/1982 | Chandley et al. | 164/63 |
| 4,606,396 | 8/1986 | Chandley et al. | 164/255 |
| 4,616,691 | 10/1986 | Voss | 164/63 X |
| 4,632,171 | 12/1986 | Almond | 164/255 |
| 4,641,703 | 2/1987 | Voss et al. | 164/255 |
| 4,658,880 | 4/1987 | Voss | 164/255 |
| 4,745,962 | 5/1988 | Mercer et al. | 164/63 X |

FOREIGN PATENT DOCUMENTS

| | | | |
|---|---|---|---|
| 59-232661 | 12/1984 | Japan | 164/63 |

OTHER PUBLICATIONS

Chandley, G. D., "Automatic Counter Gravity Casting of Shell Molds", in *Modern Casting*, Oct. 1983, pp. 29–31.

*Primary Examiner*—Nicholas P. Godici
*Assistant Examiner*—J. Reed Batten, Jr.
*Attorney, Agent, or Firm*—Reising, Ethington, Barnard, Perry & Milton

[57] ABSTRACT

A vacuum countergravity casting apparatus includes a vacuum chamber and a gas permeable mold sealingly mounted in the mouth of the chamber and comprising a gas permeable upper mold member and a lower mold member held in sealing engagement at a mold parting plane without glue. To this end, the upper mold member includes an exterior mold surface confronted by the vacuum chamber and a plurality of vacuum passages extending between the exterior mold surface and a bottom parting surface thereof to expose an effective area of the lower mold member to subambient pressure in the chamber sufficient to urge the lower mold member into sealing engagement with the upper mold member at the mold parting plane. The vacuum chamber includes a mold-engaging stop member for engaging the upper mold member and limiting movement of the upper mold member inwardly of the vacuum chamber away from the lower mold member as the latter is urged into sealing engagement therewith.

16 Claims, 2 Drawing Sheets

VACUUM COUNTERGRAVITY CASTING APPARATUS AND METHOD

FIELD OF THE INVENTION

The invention relates to the vacuum countergravity casting of molten metal in a gas-permeable mold and, more particularly, to the vacuum countergravity casting of molten metal in a gas-permeable mold having an upper mold member (cope-portion) and lower mold member (drag portion) held together in such a manner as to eliminate the need to adhesively bond the mold members at the mold parting plane and to resist destructive flexure of the mold during casting.

BACKGROUND OF THE INVENTION

A vacuum countergravity casting process using a porous, gas-permeable mold is described in such prior patents as the Chandley et al U.S. Pats. Nos. 4,340,108 issued July 20, 1982 and 4,606,396 issued Aug. 19, 1986. That countergravity casting process involves providing a mold having a porous, gas-permeable upper mold member (cope portion) and a lower mold member (drag portion) adhesively held together at a generally horizontal mold parting plane therebetween, sealing the bottom lip of a peripheral wall of a vacuum chamber to the mold such that the vacuum chamber confronts the gas permeable upper mold member, submerging the bottom side of the lower mold member in an underlying molten metal pool and evacuating the vacuum chamber to draw the molten metal through one or more ingate passages in the lower mold member and into one or more mold cavities formed between the upper and lower mold members. U.S. Pat. No. 4,340,108 seals the mold to the mouth of the vacuum chamber such that the mold parting plane lies outside the vacuum chamber. On the other hand, U.S. Pat. No. 4,632,171 seals the mold to the mouth of the vacuum chamber atop the drag portion such that the mold parting plane lies within the vacuum chamber.

U.S. Pat. No. 4,658,880 mounts the mold to the vacuum chamber by means of a plurality of reciprocable and rotatable shafts having self-tapping threads on the lower ends thereof engaging mounting sites atop the mold. Reversible motors rotate the shafts so as to screw the threads into engagement/disengagement with the mounting sites to mount/demount the mold relative to the vacuum chamber. Screwing of the threads into the mounting sites draws the mold into sealing engagement with the mouth of the vacuum chamber. Chandley, G. D. *Automatic Countergravity Casting of Shell Molds,* Modern Casting, Oct. 1983, pages 29–31, mounts round molds to a round vacuum chamber wherein the inside surface of the vacuum chamber includes self-tapping threads which screw into the periphery of the round mold. U.S. patent application Ser. No. 147,863 filed Jan. 25, 1988 and now abandoned describes a technique for mounting the mold to the vacuum box via a plurality of T-bar keepers engaging anchoring cavities in the mold.

When the aforesaid mold-vacuum chamber mounting arrangements are used with thin molds having more than about 400 square inches of mold confronting the vacuum chamber, there is a tendency for the molds to bow or flex inwardly of (into) the chamber when the casting vacuum is drawn in the chamber. This flexure can destroy the mold by forming cracks therein if not total fracture (i.e., implosion) of the mold into the chamber.

The aforesaid references all disclose gas-permeable molds wherein the upper and lower mold members are adhered (glued) together at the mold parting plane. The gluing process for holding the upper and lower mold members together is expensive and time consuming and elimination thereof would improve the efficiency and economics of the vacuum countergravity casting process. One technique for eliminating the need to glue the upper and lower mold members together and for resisting destructive flexure of the mold is the subject of copending U.S. patent application Ser. No. 198,229, filed May 25, 1988 of common inventorship and assignee herewith.

In copending U.S. patent application Ser. No. 198,229, a gas impermeable or permeable septum is provided in the vacuum housing and overlies the upper mold member for contacting the upper surface thereof to transmit ambient pressure to the upper mold member in opposition to the ambient pressure transmitted to the lower mold member when the mold cavities in the mold are evacuated by establishing a subambient pressure in a space between the septum and the upper mold member. A differential pressure is thereby applied on the mold in such a manner as to resist destructive mold flexure and hold the upper and lower mold members together at the mold parting plane without the need for glue therebetween. However, this technique for holding the mold members together without glue may not be amenable to certain mold configurations having numerous ingate passages extending between the mold cavities and the bottom side of the lower mold member. The presence of such numerous ingate passages may render the vacuum internal of the mold (e.g. at the parting plane) inadequate to establish a negative differential pressure on the mold sufficient to hold the lower and upper mold members together without glue.

Another technique for eliminating the need to glue the upper and lower mold members together and resisting destructive mold flexure is the subject of copending U.S. patent application Ser. No. 211,020 filed June 24, 1988 of common assignee herewith wherein spring means is provided in the vacuum chamber for pressing the upper mold member into sealing engagement with the lower mold member (sans adhesive) when the mold is mounted to the mouth of the vacuum chamber with the lower mold member sealingly engaged to the mouth.

Still other techniques to this same end (i.e., eliminating gluing of the upper and lower mold members and resisting destructive mold flexure) are the subject of copending U.S. patent application Ser. Nos. 211,023 and 211,024 filed June 24, 1988 of common assignee herewith. These techniques provide substantially rigid means for pressing the upper and lower mold members sealingly together at the mold parting plane when the mold is mounted to the mouth of the vacuum chamber.

It is an object of the present invention to provide an improved apparatus and method for the vacuum countergravity casting of molten metal including means for sealingly engaging the upper and lower mold members together at the mold parting plane by differential pressure effects (sans glue) and resisting destructive flexure of the mold after the mold is mounted to the mouth of the vacuum chamber and the vacuum chamber is evacuated. It is another object of the invention to provide such improved apparatus and method wherein the means for sealingly engaging the upper and lower mold members together without glue is useful with a wide range of mold designs including those having numerous ingate passages between the mold cavities and the bottom side of the lower mold member. These and other objects and advantages of the present invention will become more readily apparent from the detailed description which follows.

SUMMARY OF THE INVENTION

The present invention contemplates a vacuum countergravity apparatus comprising a mold including a gas permeable upper mold member having a bottom parting surface, an exterior surface, and a mold cavity at least in part defined therein and a lower mold member having an upper parting surface engageable with the bottom parting surface of the upper mold member to form a parting plane therebetween, a bottom surface adapted for immersion in a molten metal pool underlying the mold and an ingate passage for admitting the molten metal into the mold cavity upon evacuation of the mold cavity. A housing is provided and defines a vacuum chamber confronting the exterior surface of the upper mold member for evacuating the mold cavity, the housing including a lower end defining a mouth receiving and sealingly engaging the mold. The apparatus also includes means for establishing a subambient pressure in the vacuum chamber to evacuate the mold cavity through the gas permeable, upper mold member, and means for sealingly engaging the lower mold member and the upper mold member at the parting plane. The means for sealingly engaging the lower and upper mold members comprises (1) means for limiting movement of the upper mold member inwardly of the vacuum housing away from the lower mold member and (2) a plurality of vacuum passages extending through the upper mold member between the exterior surface thereof and the bottom parting surface for exposing an effective area of the lower mold member to the subambient pressure in the vacuum chamber sufficient to urge the lower mold member into sealing engagement with the upper mold member at the parting plane without glue. In a preferred embodiment, the chamber engages the lower mold member and the means for limiting movement of the upper mold member also aids in resisting destructive flexure of the mold when the subambient pressure is established in the vacuum chamber.

The means for limiting movement of the upper mold member away from the lower mold member when the vacuum chamber is evacuated may assume various forms such as one or more rigid stops, resilient springs, or a gas permeable or impermeable septum positioned in the vacuum housing for engagement with the upper mold member.

Each vacuum passage in the upper mold member is separated from the mold cavities by a mass of mold-forming material therebetween whereby the mass obstructs gas flow through the vacuum passages when the mold cavities are evacuated.

The present invention also contemplates a method of vacuum countergravity casting of molten metal into a mold having a gas permeable upper mold member and a lower mold member engaged together at a parting plane, comprising sealing the mold in the mouth of a vacuum chamber such that the chamber confronts an exterior surface of the gas permeable upper mold member, establishing a subambient pressure in the vacuum chamber, limiting movement of the upper mold member away from the lower mold member when the subambient pressure is established in the vacuum chamber, and exposing a sufficient area of the lower mold member to the subambient pressure through a plurality of vacuum passages formed through the upper mold member between the exterior surface thereof and the parting plane to urge the lower mold member into sealing engagement with the upper mold member at the mold parting plane without the need for adhesive.

BRIEF DESCRIPTION OF THE DRAWINGS

The invention may be better understood when considered in light of the following detailed description of certain specific embodiments thereof which is given hereafter in conjunction with the following drawings in which.

DETAILED DESCRIPTION OF CERTAIN EMBODIMENTS OF THE INVENTION

Figure 1:
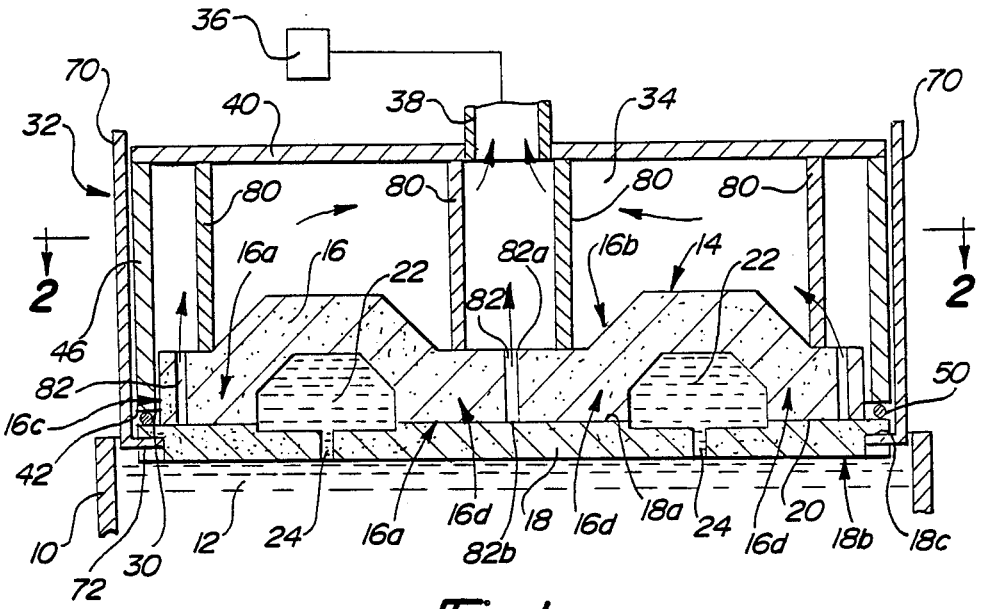
FIGS. 1, 3 and 4 are sectioned elevational views of different embodiments of a vacuum countergravity casting apparatus in accordance with the invention taken along the longitudinal centerline of the apparatus.

FIG. 1 illustrates a vacuum countergravity casting apparatus in accordance with one embodiment of the invention. The apparatus includes a container 10 of molten metal 12 to be drawn up into the mold 14. The mold 14 includes a porous, gas permeable upper mold member (cope) 16 and a lower mold member (drag) 18, which may be gas permeable or impermeable. The upper mold member 16 includes a bottom parting surface **16*a*, an exterior upwardly facing surface 16*b* and exterior side surface 16*c*. The lower mold member 18 includes an upper parting surface 18*a* that is engaged with the bottom parting surface 16*a* of the upper mold member 16 to form a parting line or plane 20 between the upper and lower mold members 16,18. Defined between the upper and lower mold members are a plurality of mold cavities 22 (two shown) to be filled with molten metal from container 10 through ingate passages 24 on the bottom surface 18*b* of lower mold member 18 when the mold cavities are evacuated with the bottom surface 18*b* submerged in the molten metal 12. To this end, each ingate passage 24 extends from the bottom surface 18*b* of the lower mold member to the respective mold cavity 22 formed thereabove at least in part in the upper mold member 16. The number, size and spacing of the mold cavities 22 and the ingate passages 24** will vary with the type of part to be cast and the particular metal to be cast as explained in U.S. Pat. No. 4,340,108, the teachings of which are incorporated herein by reference.

Upper and lower mold members 16,18 can be made of resin-bonded sand in accordance with known mold practice wherein a mixture of sand or equivalent particles and bonding material is formed to shape and cured or hardened against a contoured metal pattern (not shown) having the desired complementary contour or profile for forming the parting surfaces **16*a*, 18*a* and the mold cavities 22 in the upper and lower mold members 16, 18. The bonding material may comprise inorganic or organic thermal or chemical setting plastic resin or equivalent bonding material. The bonding material is usually present in minor percentage, such as less than about 5% by weight of the mixture. However, the invention is not limited to resin-bonded sand molds and may find use with other types of non-metallic refractory molds; e.g., investment molds of the high temperature ceramic type known in the art, such as investment molds made from alumina, zircon, fused quartz and like ceramic particulate and binder, such as colloidal silica. The upper mold member 16 and the lower mold member 18 may be made of the same or different mold material. In any case, upper mold member 16 is made of a porous, gas permeable material which permits gases to be withdrawn from the mold cavities 22 when a relative vacuum is applied on the exterior upper surface 16***b* and the exterior side surface 16*c* of the upper mold member 16 as described hereinbelow.

Mold 14 may be made in various exterior shapes (e.g., rectangular, circular, etc.). A particularly convenient and efficient mold is one in which upper and lower mold members 16,18 are generally rectangular in shape as shown best in FIG. 2.

The mold 14 is sealingly received in the mouth 30 of a vacuum housing 32 that defines a vacuum chamber 34 confronting the exterior upper surface 16*b* and the exterior side surface 16*c* of the gas-permeable, upper mold member 16, FIG. 1. The vacuum chamber 34 is communicated to a vacuum source 36 through a conduit 38 sealingly connected to the upper end wall (ceiling) 40 of the housing 32 so that the mold cavities 22 can be evacuated through the gas permeable, upper mold member 16 to draw the molten metal 12 through the bottom ingate passages 24 when the bottom surface 18*b* of the lower mold member 18 is immersed in the molten metal 12.

The mouth 30 of the vacuum housing 32 is defined by a bottom lip 42 on a peripheral wall 46 that depends from the upper end wall 40 and a compressible, sealing gasket 50 secured on the bottom lip 42. Suitable means, such as disclosed in the references discussed hereinabove, are used to hold the mold 14 in the mouth 30 of the Vacuum chamber 34 with the sealing gasket 50 compressed between the bottom lip 42 and the upper surface 18*a* of the lower mold member 18.

For example, as described in the aforesaid copending application Ser. No. 211,020, the teachings of which are incorporated herein by reference as it relates to means for mounting the mold 14 and the vacuum housing 32 together, the mold 14 can be supported on hangers 70 having L-shaped hooks 72 which carry the mold 14 from a loading station to the casting station shown in FIG. 1. In operation, the mold 14 is first placed on the hangers 70 (i.e., at the loading station) and the vacuum housing 32 is lowered to sealingly engage the mouth 30 (defined by lip 42 and sealing gasket 50) to the lower mold member 18. The coupled mold 14 and the vacuum housing 32 are then transferred to the casting station where the bottom side 18*b* of the lower mold member 18 is immersed in the melt and the vacuum chamber 34 is evacuated to effect countergravity casting in known manner.

In accordance with the invention, when the vacuum chamber 34 is evacuated at the casting station of FIG. 1, to effect countergravity casting, the lower mold member 18 is urged upwardly into sealing engagement with the upper mold member 16 at the parting plane 20 to prevent molten metal leakage at the parting plane 20 as the mold cavities 22 are filled with the molten metal 12. In particular, when the vacuum chamber 34 is evacuated, the upper surface 16*b* of the upper mold member 16 is brought into abutting engagement with a plurality of rigid, elongate, cylindrical or other shape stops 80 depending from the upper end wall 40 of the vacuum housing 32. At the same time, the lower mold member 18 is urged upwardly to sealingly engage the upper surface 18*a* thereof against the bottom surface 16*a* of the upper mold member 16, which is held against movement away from the lower mold member 18 by engagement with the stops 80 as shown in FIG. 1. To this end, the upper mold member 16 includes a plurality of horizontally spaced apart vacuum passages 82 extending therethrough between the exterior upper surface 16*b* and the bottom surface 16*a* to expose a minimum effective area of the upper surface 18*a* of the lower mold member 18 to the subambient pressure in the vacuum chamber 34 sufficient to urge the lower mold member 18 upwardly into sealing engagement with the upper mold member 16 at the parting plane 20.

Figure 2:
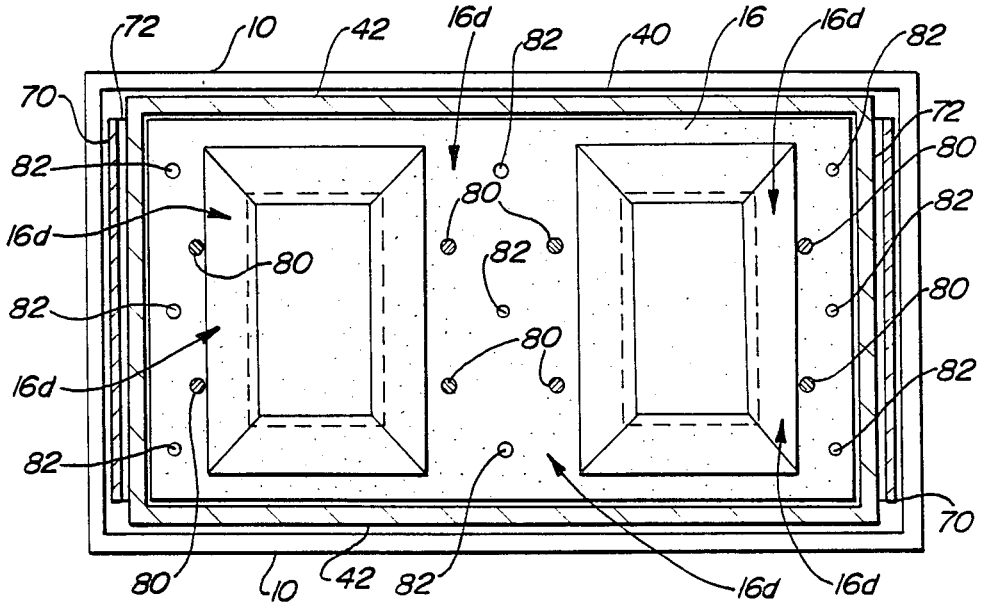
FIG. 2 is an elevational (plan) view taken along lines 2—2 of FIG. 1.

The vacuum passages 82 each include an open upper end 82*a* and an open lower end 82*b* dead-ending onto the lower mold member 18 at or adjacent the mold parting plane 20 and are separated horizontally from the mold cavities 22 by walls or masses 16*d* of the mold-forming material of the upper mold member 16. The vacuum passages 82 thus are not directly interconnected to the mold cavities 22. Instead, an obstruction in the form of the masses 16*d* of the mold material is provided between each vacuum passage 82 and the adjacent mold cavities 22 to substantially obstruct, during evacuation of the vacuum chamber 34, the flow of gases into the vacuum passages 82. As a result, the level of subambient pressure established in the vacuum chamber 34 can be substantially maintained in the vacuum passages 82 and on the exposed areas of the upper surface 18*a* of the lower mold member 18 at the parting plane 20. Those skilled in the art will appreciate that the cross-sectional area, number, shape and spatial distribution of the vacuum passages 82 in the upper mold member 16 can be varied as needed to expose (i.e., for a given vacuum and number/size of ingate passages 24 and mold cavities 22) the minimum effective area of the lower mold member 18 directly to the subambient pressure in the chamber 34 required to effect sealing engagement of the lower mold member 18 with the upper mold member 16 at the mold parting plane 20. Generally speaking the more area of upper surface 18*a* exposed to the vacuum in the chamber 34, the greater the holding-/sealing power. The amount of exposed area of surface 18*a* required depends on the weight of the lower mold member 18 as well as the surface area occupied by the mold cavities 22 in the upper mold member 16 and the thickness of the upper mold member 16. FIG. 2 illustrates a particular distribution of vacuum passages 82 to this end.

Although the vacuum passages 82 are shown in FIGS. 1–2 as extending between the upwardly facing exterior surface 16*b* and the bottom surface 16*a* of the upper mold member 16, the vacuum passages 82 may extend between the exterior side surface 16*c* of the upper mold member 16 and the bottom surface 16*a* thereof to expose the required minimum effective area of the lower mold member 18 directly to the subambient pressure in the vacuum chamber 34.

Those skilled in the art will appreciate that the rigid stops 80 prevent destructive flexing of the mold 14 inwardly into the vacuum housing 32 when the vacuum chamber 34 is evacuated and that the stops 80 may be secured on the peripheral wall 46 of the vacuum housing 32 instead of on the upper end wall 40. Alternatively, the stops may be formed as upstanding projections or towers (not shown) atop the upper mold member 16 for engagement with the ceiling of the housing 32. Preferably, the stops 80 depend from the ceiling of the housing and engage the upper surface 16*b* above sections of the upper mold member 16 that are devoid of the mold cavities 22.

Figure 3:
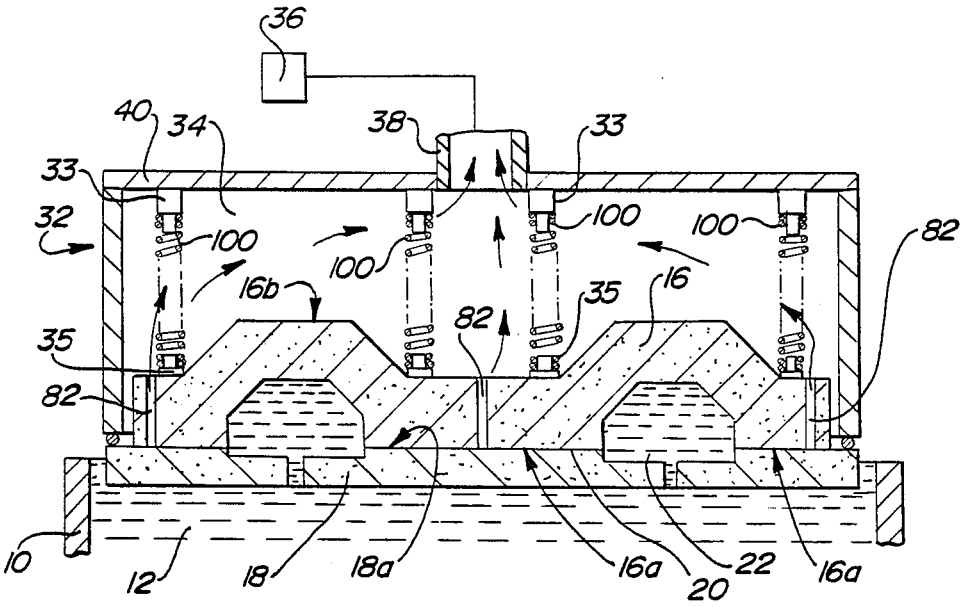

FIG. 3 illustrates another embodiment of the vacuum, countergravity casting apparatus of the invention similar to that of FIG. 1 but differing therefrom in having coil spring stops 100 substituted for the rigid stops 80 as a means for limiting upward movement of the upper mold member 16 away from the lower mold member 18. Each spring stop 100 is suspended from the upper end wall 40 of the vacuum housing 32 by a stud 33 attached to the upper end wall 40 and carries a foot 35 at its lower end to engage the upper exterior surface 16*b* of the mold member 16 and distribute force in such a manner on the upper surface 16*b* of the upper mold member 16 to prevent penetration/puncture thereof. The spring stops 100 function in the same general manner as the rigid stops 80 but are advantageous thereover since the spring stops 100 can accommodate typical variations in dimensions and in flatness of the mold surfaces from one mold 14 to the next arising from the particular mold-making procedures employed.

Figure 4:
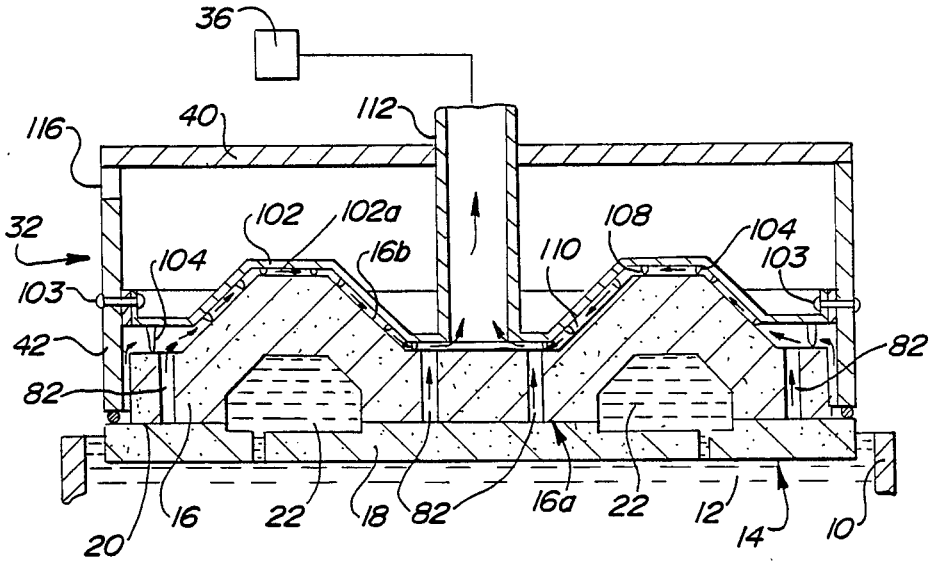

A further embodiment of the invention is illustrated in FIG. 4 and differs from those described hereinabove in having a gas impermeable septum 102 positioned in the housing 32 in lieu of the rigid stops 80 or stop springs 100 to limit movement of the upper mold member 16 upwardly away from the lower mold member 18. In particular, the gas impermeable septum 102 is fastened (e.g. by rivets 103) to the peripheral wall 4 of the housing 32 and overlies and follows the contour of the upper surface 16*b* of the upper mold member 16. A plurality of standoffs 104 are spaced apart on the inner or lower side 102*a* of the septum 102 and extend toward and into engagement with the upper surface 16*b* to provide a plurality of spaced apart contact regions 108 between the septum 102 and the upper surface 16*b*. The plurality of standoffs 104 define a vacuum chamber 110 between the septum 102 and the upper surface 16*b*. A vacuum conduit 112 is sealingly attached to the septum 102 and extends through the upper end wall 40 of the vacuum housing 32 to a vacuum source 36 to evacuate the chamber 110. Ambient pressure is provided in the housing 32 above the septum 102 by venting the housing to ambient pressure through one or more apertures 116 (only one shown).

When the vacuum chamber 110 is evacuated at the casting station of FIG. 4, a plurality of vacuum passages 82 extending through the upper mold member 16 (between bottom parting surface 16*a* and upper surface 16*b*) expose the aforementioned minimum effective area of the lower mold member 18 at the parting plane 20 directly to the subambient pressure in the chamber 110 while ambient pressure above the septum 102 is transmitted to the upper mold member 16 by the standoffs 104 in opposition to ambient pressure transmitted through the molten metal 12 to the bottom side 18*b* of the lower mold member 18. In this way, a negative differential pressure is established on the mold 14 sufficient to hold the upper and lower mold members 16,18 together at the parting plane 20 without glue therebetween. A gas permeable septum (not shown) and differently configured housing may be used in lieu of the gas impermeable septum 102 and housing 32 as taught in the aforementioned copending U.S. patent application Ser. No. 198,229 filed May 25, 1988, the teachings of which are incorporated herein by reference.

It is thus apparent from the description hereinabove that the present invention provides an apparatus and method for sealingly engaging the upper and lower mold members 16,18 at the mold parting plane 20 without the need for glue or other adhesive therebetween and for resisting destructive flexure of the mold 14 inwardly of the vacuum housing 32. Elimination of the need to glue the upper and lower mold members 16,18 together at the mold parting plane 20 significantly reduces the cost and time for making the casting mold 14 as those skilled in the art will appreciate.

While the invention has been described in terms of specific embodiments thereof, it is not intended to be limited thereto but rather only to the extent set forth hereafter in the claims which follow.

I claim:

1. Apparatus for the vacuum countergravity casting of molten metal, comprising:

(a) a mold comprising a gas permeable upper mold member having a bottom parting surface, an exterior surface and a mold cavity at least in part defined therein and a lower mold member having an upper parting surface engageable with the bottom surface of the upper mold member to form a parting plane therebetween, a bottom surface adapted for immersion in a molten metal pool underlying said mold and an ingate passage for admitting said molten meal into said mold cavity upon evacuation of said mold cavity, (b) a housing defining a vacuum chamber confronting the exterior surface of the gas permeable upper mold member for evacuating the mold cavity through said upper mold member, said housing including a lower end defining a mouth receiving and sealingly engaging the mold, (c) means for establishing a subambient pressure in the vacuum chamber to evacuate said mold cavity through said gas permeable upper mold member, and (d) means for sealingly engaging the lower mold member and the upper mold member at the parting plane, said means comprising (1) means for limiting movement of the upper mold member inwardly of the vacuum housing away from the lower mold member and (2) a plurality of vacuum passages extending through the upper mold member between said exterior surface and said bottom parting surface for exposing an effective area of the lower mold member to the subambient pressure in the vacuum chamber sufficient to urge the lower mold member into sealing engagement with the upper mold member at the parting plane without the need for adhesive therebetween.

2. Apparatus for the vacuum countergravity casting of molten metal, comprising:

(a) a mold comprising a gas permeable upper mold member having a bottom parting surface, an exterior surface, and a mold cavity at least in part defined therein and a lower mold member having an upper parting surface engageable with the bottom surface of the upper mold member to form a parting plane therebetween, a bottom surface adapted for immersion in a molten metal pool underlying said mold and an ingate passage for admitting said molten metal into said mold cavity upon evacuation of said mold cavity, (b) a housing defining a vacuum chamber confronting the exterior surface of the gas permeable upper mold member for evacuating the mold cavity through said upper mold member, said housing including a lower end defining a mouth receiving and sealingly engaging the lower mold member, (c) means for establishing a subambient pressure in the vacuum chamber to evacuate said mold cavity through said gas permeable upper mold member, and (d) means for sealingly engaging the lower mold member and the upper mold member at the parting plane, said means comprising (1) means in the vacuum housing for limiting movement of the upper mold member inwardly of the vacuum housing away from the lower mold member and (2) a plurality of vacuum passages extending through the upper mold member between said exterior surface and said bottom parting surface for exposing an effective area of the lower mold member to the subambient pressure in the vacuum chamber sufficient to urge the lower mold member into sealing engagement with the upper mold member at the parting plane without the need for adhesive therebetween.

3. The apparatus of claim 2 wherein the means for limiting movement of the upper mold member comprises a stop means in the vacuum housing for engaging the upper mold member.

4. The apparatus of claim 3 wherein the stop means overlies and engages an upper exterior surface of the upper mold member.

5. The apparatus of claim 4 wherein the stop means comprises a plurality of rigid stop members secured on the vacuum housing.

6. The apparatus of claim 5 wherein the stop members depend from a ceiling of the vacuum housing.

7. The apparatus of claim 4 wherein the stop means comprises a plurality of spring members secured on the vacuum housing.

8. The apparatus of claim 7 wherein the spring members depend from the ceiling of the vacuum housing.

9. The apparatus of claim 3 wherein the means for limiting movement of the upper mold member comprises a septum in the vacuum housing overlying the upper mold member for exerting ambient pressure thereon toward the lower mold member.

10. The apparatus of claim 2 wherein the vacuum passages extend between an exterior upwardly facing surface of the upper mold member and the bottom parting surface.

11. The apparatus of claim 2 wherein each vacuum passage is separated from the mold cavities by a mass of mold-forming material therebetween whereby gas flow through said vacuum passages is obstructed when the mold cavities are evacuated.

12. In the vacuum countergravity casting of molten metal into a mold having a gas permeable upper mold member defining at least in part a mold cavity and having a lower mold member engageable therewith at a mold parting plane and formed with an ingate passage on a bottom side for admitting the molten metal into the mold cavity, the steps of:

(a) sealing the mold in the mouth of a vacuum chamber such that the vacuum chamber confronts an exterior surface of the gas permeable upper mold member, (b) establishing a subambient pressure in the vacuum chamber, (c) limiting movement of the upper mold member inwardly of the vacuum chamber away from the lower mold member when the vacuum chamber is evacuated, and (d) exposing a sufficient area of the lower mold member to the subambient pressure through a plurality of vacuum passages extending through the upper mold member between the exterior surface thereof and the parting plane to urge the lower mold member into sealing engagement with the upper mold member at the mold parting plane without the need for adhesive therebetween.

13. The method of claim 12 wherein movement of the upper mold member is limited by engaging the upper mold member with a stop means disposed in the vacuum chamber.

14. The method of claim 12 wherein movement of the upper mold member away from the lower mold member is limited by applying ambient pressure thereon toward the lower mold member.

15. The method of claim 12 wherein the vacuum passages are formed through the upper mold member between an exterior upwardly facing surface and a bottom parting surface thereof forming part of the parting plane.

16. The method of claim 12 wherein each vacuum passage is formed through the upper mold member such that a mass of mold-forming material separates each vacuum passage and the adjacent mold cavities, whereby gas flow through the vacuum passages is obstructed when the subambient pressure is established in the vacuum chamber.

* * * * *

UNITED STATES PATENT AND TRADEMARK OFFICE

CERTIFICATE OF CORRECTION

PATENT NO. : 4,862,946

DATED : September 5, 1989

INVENTOR(S) : George D. Chandley

It is certified that error appears in the above-identified patent and that said Letters Patent is hereby corrected as shown below:

In the specification:

Column 5, line 38, change "Vacuum" to --vacuum--.
Column 8, line 30, change "meal" to --metal--.

Signed and Sealed this

Twenty-fifth Day of December, 1990

*Attest:*

HARRY F. MANBECK, JR.

*Attesting Officer*

*Commissioner of Patents and Trademarks*